US008102344B2

(12) United States Patent
Lee et al.

(10) Patent No.: US 8,102,344 B2
(45) Date of Patent: Jan. 24, 2012

(54) DISPLAY DEVICE AND METHOD FOR DRIVING THE SAME

(75) Inventors: Seung-Hoon Lee, Yongin-si (KR); Jun-Woo Lee, Anyang-si (KR); Hee-Seop Kim, Hwaseong-si (KR); Eun-Hee Han, Seoul (KR); Hong-Jo Park, Suwon-si (KR); Sung-Jae Yun, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 985 days.

(21) Appl. No.: 12/046,992

(22) Filed: Mar. 12, 2008

(65) Prior Publication Data

US 2008/0224975 A1 Sep. 18, 2008

(30) Foreign Application Priority Data

Mar. 14, 2007 (KR) ..... 10-2007-0025086

(51) Int. Cl.
*G09G 3/36* (2006.01)

(52) U.S. Cl. ..... 345/89; 345/77; 345/87

(58) Field of Classification Search ..... 345/89, 345/77, 87

See application file for complete search history.

(56) References Cited

U.S. PATENT DOCUMENTS

| | | | | |
|---|---|---|---|---|
| 7,542,055 | B2 * | 6/2009 | Matsuda et al. | 345/690 |
| 2003/0053001 | A1 * | 3/2003 | Murashita et al. | 348/649 |
| 2006/0055661 | A1 | 3/2006 | Kawaguchi | |
| 2006/0221031 | A1 | 10/2006 | Chang et al. | |
| 2006/0256051 | A1 * | 11/2006 | Lee et al. | 345/87 |
| 2007/0070008 | A1 * | 3/2007 | Shin et al. | 345/89 |
| 2008/0100553 | A1 * | 5/2008 | Shen et al. | 345/89 |

FOREIGN PATENT DOCUMENTS

| | | |
|---|---|---|
| JP | 2003-029303 | 1/2003 |
| JP | 2006-084710 | 3/2006 |
| KR | 1020060051289 | 5/2006 |
| KR | 2006-0105188 | 10/2006 |

* cited by examiner

*Primary Examiner* — Richard Hjerpe
*Assistant Examiner* — Sahlu Okebato
(74) *Attorney, Agent, or Firm* — F. Chau & Associates, LLC

(57) ABSTRACT

A method for driving a display device includes: dividing an entire gray-scale region corresponding to a data gray scale into a first gray-scale region and a second gray-scale region and setting a first gamma value of the first gray-scale region and a second gamma value of the second gray-scale region, the first gamma value being smaller than the second gamma value; providing a first gray-scale display voltage corresponding to the data gray scale to a display panel during a first section of one horizontal period by using the first gamma value or the second gamma value selected by an inputted data gray scale; and providing a second gray-scale display voltage corresponding to a black gray scale to the display panel during a second section of the one horizontal period.

11 Claims, 5 Drawing Sheets

DISPLAY DEVICE AND METHOD FOR DRIVING THE SAME

CROSS-REFERENCE TO RELATED APPLICATION

This application claims priority to and the benefit of Korean Patent Application No. 2007-0025086, filed on Mar. 14, 2007, the disclosure of which is incorporated herein by reference in its entirety.

BACKGROUND OF THE INVENTION

1. Technical Field

The present disclosure relates to a display device and a method for driving the same and, more particularly, to a display device that is driven in an impulsive method and a method for driving the same.

2. Discussion of Related Art

A typical liquid crystal display (LCD) device comprises a thin-film transistor (TFT) substrate having a pixel electrode and a color filter substrate having a common electrode with a liquid crystal layer interposed therebetween. In an LCD device, due to an electric field formed when a pixel voltage is applied to a pixel electrode and a common voltage is applied to a common electrode, an alignment of a liquid crystal in the liquid crystal layer changes to adjust light transmittance, thereby displaying an image.

As opposed to a cathode ray tube (CRT) that is driven in an impulsive method, an LCD device is driven in a hold-type method and so has a motion blur phenomenon wherein an image is transformed according to a moving direction of an image.

As a method for removing the motion blur phenomenon in an LCD device, there are an impulsive driving method that inserts black data or uses a backlight blinking and a method for speeding up a frame rate.

The impulsive driving method is attracting public attention because it can be realized by only changing a control signal of an LCD device. More specifically, if an impulsive driving method that inserts black data is applied to an optically compensated bend (OCB) mode, there are advantages in that a bend state is maintained at a voltage lower than a critical voltage and the visibility of the moving picture is improved.

The impulsive driving method in the OCB mode has a problem, however, in that there occurs a gray inversion, that is, a gray-scale inversion phenomenon in which a high gray-scale luminance is lower than a low gray-scale luminance, because side visibility of a side image shown in the same direction as a rubbing direction is asymmetric to side visibility of a side image shown in a perpendicular direction to the rubbing direction.

SUMMARY OF THE INVENTION

Exemplary embodiments of the present invention solve the aforementioned problems associated with conventional devices by providing a display device in which a luminance difference between gray scales is increased by raising a gamma value of a data gamma curve particularly in a high gray-scale region and a method for driving the same.

An exemplary embodiment of the present invention provides a method for driving a display device, comprising: dividing the whole gray-scale region corresponding to a data gray-scale into a first gray-scale region and a second gray-scale region and setting a first gamma value of the first gray-scale region and a second gamma value of the second gray-scale region, the first gamma value being smaller than the second gamma value; providing a first gray-scale display voltage corresponding to the data gray-scale to a display panel during a first section of one horizontal period by using the first gamma value or the second gamma value selected by an inputted data gray-scale; and providing a second gray-scale display voltage corresponding to a black gray-scale to the display panel during a second section of the one horizontal period.

The second gray-scale region has a larger data gray-scale than the first gray-scale region.

The second gray-scale region occupies about 10% to about 40% of the whole gray-scale region.

The first gamma value is set to between 2.1 to 2.3, and the second gamma value is set to between 2.4 to 3.1.

An exemplary embodiment of the present invention provides a display device, comprising: a display panel having a liquid crystal that operates in response to first and second gray-scale display voltages; and a display panel driver for converting externally inputted data into the first and second gray-scale display voltages by using first and second gamma curves and providing the first and second gray-scale display voltages to the display panel, wherein the first gamma curve has a first gamma value of a first gray-scale region and a second gamma value of a second gray-scale region, the first gamma value being larger than the second gamma value.

The first and second gray-scale display voltages are provided by the display panel driver to the display panel during one horizontal period.

The first gamma curve is a gamma curve applied to the data, and the second gamma curve is a gamma curve used for impulsive driving.

The whole gray-scale region that the data has is a gray-scale region obtained by adding the first gray-scale region and the second gray-scale region, and the second gray-scale region occupies about 10% to about 40% of the whole gray-scale region.

The whole gray-scale region comprises a 1 to 256 gray scale, the first gray-scale region comprises a 1 to 199 gray scale, and the second gray-scale region comprises a 200 to 256 gray scale.

The first gamma value is between about 2.1 to about 2.3, and the second gamma value is between about 2.4 to 3.1.

The display panel driver comprises a storage portion for storing the data inputted at a first driving frequency, and a timing controller for synchronizing the data stored in the storage portion with a second driving frequency that is a multiple of the second driving frequency before reading out.

The display panel driver further comprises a gamma voltage generator comprising a first gamma resistor portion having a characteristic of the first gamma value and a second gamma resistor portion having a characteristic of the second gamma value, the first gamma resistor portion generating a first reference gamma voltage, the second gamma resistor portion generating a second reference gamma voltage; and a data driver for generating the first gray-scale display voltage corresponding to a gray scale of the data by using the first and second reference gamma voltages and providing the first gray-scale display voltage to the display panel.

BRIEF DESCRIPTION OF THE DRAWINGS

Exemplary embodiments of the present invention will be understood in more detail from the following descriptions taken in conjunction with the attached drawings, in which.

DESCRIPTION OF EXEMPLARY EMBODIMENTS

Figure 1:
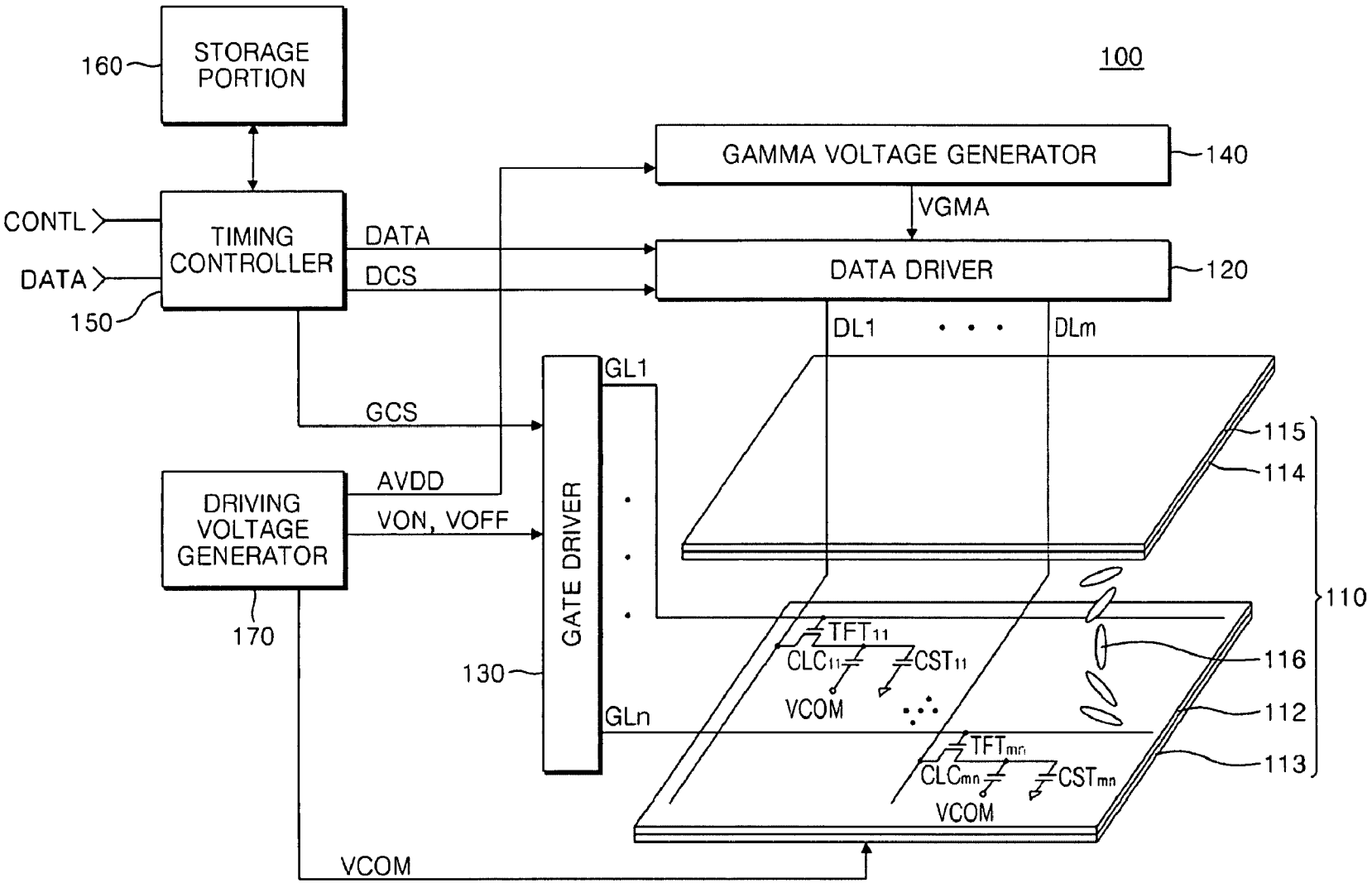
FIG. 1 is a block diagram illustrating a display device according to an exemplary embodiment of the present invention.

Reference will now be made in detail to exemplary embodiments of the present invention, which are illustrated in the accompanying drawings, wherein like reference numerals refer to the like elements throughout. The exemplary embodiments are described below in order to explain the present invention by referring to the figures.

FIG. 1 is a block diagram illustrating a display device according to an exemplary embodiment of the present invention. As shown in FIG. 1, the display device 100 comprises a display panel 110, a data driver 120, a gate driver 130, a gamma voltage generator 140, a timing controller 150, a storage portion 160, and a driving voltage generator 170. The display panel 110 may operate in an impulsive driving method in an OCB mode.

The display panel 110 comprises a color filter substrate 114 having a color filter (not shown), a common electrode (not shown) and a first polarizer plate 115, a TFT substrate 112 having TFTs and a second polarizer plate 113, and a liquid crystal layer 116 that is interposed between the color filter substrate 114 and the TFT substrate 112. The first polarizer plate 115 and the second polarizer plate 113 are arranged on the color filter substrate 114 and the TFT substrate 112, respectively, so that their polarization axes can be perpendicular to each other.

The TFT substrate 112 comprises a plurality of pixel capacitors CLC11 to CLC*mn*, a plurality of TFTs (TFT11 to TFT*mn*) for applying a gray-scale display voltage to the plurality of pixel capacitors CLC11 to CLC*mn* in response to a gate on voltage VON, and a plurality of storage capacitors CST11 to CSTmn respectively connected in parallel to the plurality of pixel capacitors CLC11 to CLC*mn* to maintain a gray-scale display voltage, which are formed at crossing points of a plurality of gate lines GL1 to GL*n* and a plurality of data lines DL1 to DL*n*.

Each of the TFTs (TFT11 to TFT*mn*) comprises a gate, a source, and a drain. For example, the TFT (TFT11) comprises a gate connected to the gate line GL1, a source connected to the data line DL1, and a drain connected to a pixel electrode of the pixel capacitor CLC11. A gray-scale display voltage comprises a first gray-scale display voltage according to first gamma information and a second gray-scale display voltage according to second gamma information. The first gray-scale display voltage and the second gray-scale display voltage are sequentially supplied to the pixel capacitors CLC11 to CLC*mn* during one horizontal period 1H. One horizontal period comprises a data display section during which the first gray-scale display voltage is applied and an impulsive section during which the second gray-scale display voltage is applied.

The liquid crystal in the liquid crystal layer 116 may operate in an OCB mode that uses a bend state as an initial driving state. To this end, a nematic liquid crystal with positive dielectric constant anisotropy is used. An alignment layer is formed on both of the common electrode of the color filter substrate 114 and the pixel electrode of the TFT is substrate 112, respectively, and then the alignment layers are rubbed in a direction that forms an angle of 35° to 55° or 125° to 145° to the polarization axis of the first polarizer plate 115, in order to splay-align the liquid crystal.

A voltage greater than a critical voltage Vc is applied to the pixel electrode and the common electrode to convert the liquid crystal into a bend state, and then the light transmittance is controlled by controlling an applied voltage. The critical voltage Vc is a minimum voltage for maintaining a bend state of a liquid crystal.

The liquid crystal in the liquid crystal layer 116 may be vertically aligned in a non-electric field state and have negative dielectric constant anisotropy. Other optical structures for an OCB mode are well known to a person having ordinary skill in the art, and their detailed descriptions will be omitted.

The data driver 120 generates a gray-scale display voltage corresponding to a data DATA gray scale by using a reference gamma voltage VGMA and applies the gray-scale display voltage corresponding to the data DATA to the pixel capacitors CLC11 to CLC*mn* of the display panel in a gate line (GL1 to GLn) unit through the plurality of TFTs TFT11 to TFT*mn* driven by the gate-on voltage VON.

The reference gamma voltage VGMA comprises a first reference gamma voltage according to a first gamma curve and a second reference gamma voltage according to a second gamma curve. The data DATA comprises display data and impulsive data in a one horizontal period (1H) unit.

To this end, the data driver 1120 receives a data control signal DCS and the data DATA from the timing controller 150 and receives the reference gamma voltage VGMA from the gamma voltage generator 140.

More specifically, the data driver 120 generates a gray-scale display voltage corresponding to the display data by using the first reference gamma voltage during the data display section and generates a gray-scale display voltage corresponding to the impulsive data by using the second reference gamma voltage during the impulsive section.

The data driver 120 may be realized by a plurality of data driving integrated circuits (ICs) and be connected to the display panel 110 in a tape carrier package (TCP) form, or may be mounted onto the TFT substrate 112 of the display panel 110 in a chip on glass (COG) form, or may be integrated directly on the TFT substrate 112 by using a poly crystalline silicon TFT.

The gate driver 130 sequentially applies the gate-on voltage VON to a plurality of gate lines GL1 to GLn and the gate-off voltage VOFF to those gate lines to which the gate-on voltage VON are not applied. That is, the gate driver 130 simultaneously turns on a plurality of TFTs respectively connected to the sequentially selected gate lines GL.

To this end, the gate driver 130 receives a gate control signal GCS from the timing controller 150 and receives the gate-on voltage VON and the gate-off voltage VOFF from the driving voltage generator 170.

The gate driver 130 may be realized by a plurality of gate driving integrated circuits (ICs) and be connected to the TFT substrate 112 in a tape carrier package (TCP) form, or may be mounted onto the TFT substrate 112 in a chip on glass (COG) form, or may be integrated on a non-display region of the TFT substrate 112 in an amorphous silicon gate form when the TFT is formed.

The gamma voltage generator 140 divides an analog power voltage AVDD supplied from the driving voltage generator 170 to generate the reference gamma voltage VGMA and provides it to the data driver 120. More specifically, the gamma voltage generator 140 generates the first reference gamma voltage by using the first gamma curve and generates the second reference gamma voltage by using the second gamma curve. The first and second gamma curves used by the gamma voltage generator 140 are described hereinbelow with reference to Table 1 and FIG. 4.

The timing controller 150 converts the data DATA externally inputted into a signal level that can be processed by the data driver 120 and provides it to the data driver 120. At this time, a resolution and a driving frequency of the display panel 110, and the type and the number of driver ICs that constitute the gate driver 113 and the data driver 120 can be considered.

The timing controller 150 generates the data control signal DCS and the gate control signal GCS by using a control signal CONTL externally inputted and provides them to the data driver 120 and the gate driver 130, respectively.

The control signal CONTL externally inputted may comprise a vertical synchronous signal, a horizontal synchronous signal, and a main clock signal. The data control signal DCS may comprise a data start pulse STH, a data synchronous clock signal CPH, a load signal TP, and a polarity inverting signal POL, and the gate control signal GCS may comprise a gate start pulse STV and a gate synchronous clock signal CPH.

The timing controller 150 stores the data DATA externally inputted at a first driving frequency in the storage portion 160 in a horizontal period unit and synchronizes it with a second driving frequency before reading it out. The first driving frequency is a main clock frequency, and the second driving frequency is a multiple frequency of the first driving frequency. For example, if the first driving frequency is 60 Hz and the second frequency is 120 Hz, a horizontal period according to the first driving frequency is displayed on the display panel 110 as a sum of the data display section and the impulsive section by the second driving frequency.

The storage portion 160 stores the data DATA externally inputted at the first driving frequency by the timing controller in a horizontal period (1H) unit. The data DATA stored in the storage portion 160 is synchronized with the second driving frequency by the timing controller 150 and then read out. The storage portion 160 may store the impulsive data for impulsive driving in a horizontal period (1H) unit.

The driving voltage generator 170 generates the gate-on voltage VON and the gate-off voltage VOFF and provides them to the gate driver 130. The driving voltage generator 170 generates the analog power voltage AVDD and the common voltage VCOM and provides them to the gamma voltage generator 140 and the display panel 110, respectively.

The driving voltage generator 170 generates a digital power voltage DVDD (not shown) for driving digital driving parts and provides it to the timing controller 150, the gate driver 130 and the data driver 120. A level of the electric power supplied to each driver from the driving voltage generator 170 may be switched by the timing controller 150 or by an external input signal.

Figure 2:
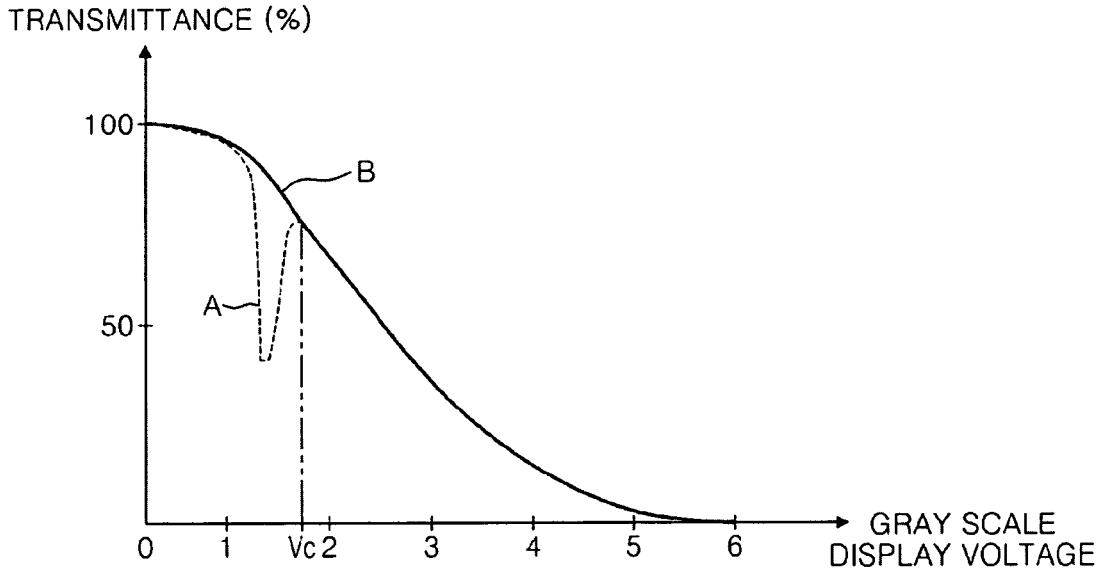
FIG. 2 is a graph illustrating a relationship between a gray-scale display voltage and transmittance in the display device of FIG. 1.

FIG. 2 is a graph illustrating a relationship between a gray-scale display voltage and light transmittance in the display device of FIG. 1. In the graph of FIG. 2, a dotted line curve A denotes a relationship between a gray-scale display voltage and light transmittance in a typical OCB mode operation, and a solid line curve B denotes a relationship between a gray-scale display voltage and transmittance in an OCB mode operation according to the impulsive driving method.

Referring to the dotted line curve A, a bend state of a liquid crystal is broken at a voltage lower than a critical voltage Vc. Therefore, in the typical OCB mode operation, the display device displays a white gray scale through a white gray-scale display voltage higher than a critical voltage Vc (about 2 volts). That is, the gray-scale display voltage applied to the display panel has a range of about 2 volts to about 6 volts.

Referring to the solid line curve B of FIG. 2, in the case of an OCB mode impulsive driving, different than the typical OCB mode operation, it is possible to display a normal white gray scale in a gray-scale display voltage region lower than the critical voltage Vc. This is possible because the time it takes until a bend alignment is broken is about 500 ms (corresponding to 30 frames), a liquid crystal can maintain a bend state during the whole driving period in the case of an impulsive driving so long as a black gray-scale display voltage higher than a critical voltage Vc is applied at least one time per one horizontal period.

According to the impulsive driving method of an exemplary embodiment of the present invention, even a gray-scale display voltage that is lower than a critical voltage Vc can be used as a white gray-scale display voltage. Accordingly, the gray-scale display voltage applied to the display panel has a range of about 0 volts to about 6 volts.

The display device 100 according to an exemplary embodiment of the present invention displays data on the display panel 110 by using the first and second gamma curves. The first and second gamma curves are described below in detail with reference to Table 1.

TABLE 1

| Gray-scale region | First gamma curves | Second gamma curves |
|---|---|---|
| First gray-scale region | First gamma value | Black gray scale |
| Second gray-scale region | Second gamma value | Black gray scale |

Referring to Table 1, the gray-scale region comprises a first gray-scale region and a second gray-scale region. The second gray-scale region is a high gray-scale region of all of the gray-scale regions that the display data can have, and the first gray-scale region is the remaining gray-scale region except for the high gray-scale region. The second gray-scale region occupies about 10% to about 40% of the whole gray-scale region.

For example, the whole gray scale may be a 64 gray scale, a 256 gray scale, or a 1024 gray scale. If the whole gray scale is a 256 gray scale, the first gray-scale region is 1 to 199 gray scales, and the second gray-scale region is 200 to 256 gray scales.

The first gamma curve has a first gamma value corresponding to the first gray-scale region and a second gamma value corresponding to the second gray-scale region, respectively. That is, the first gamma curve does not have a single gamma value but has two gamma values corresponding to the first and second gray-scale regions. The second gamma curve has a black gray-scale value regardless of the gray-scale region. More specifically, the second gamma curve has a single gamma value, that is, the black gray-scale value in the first and second gray-scale regions.

The first gamma value corresponding to the first gray-scale region is smaller than the second gamma value corresponding to the second gray scale. The first gamma value may be 2.2, and the second gamma value may be 2.4 to 3.1.

To this end, the gamma voltage generator 140 comprises a first gamma resistor portion and a second gamma resistor portion that generate reference gamma voltages based on the first and second gamma values. The gamma voltage generator 140 is described below in more detail with reference to FIG. 3.

Figure 3:
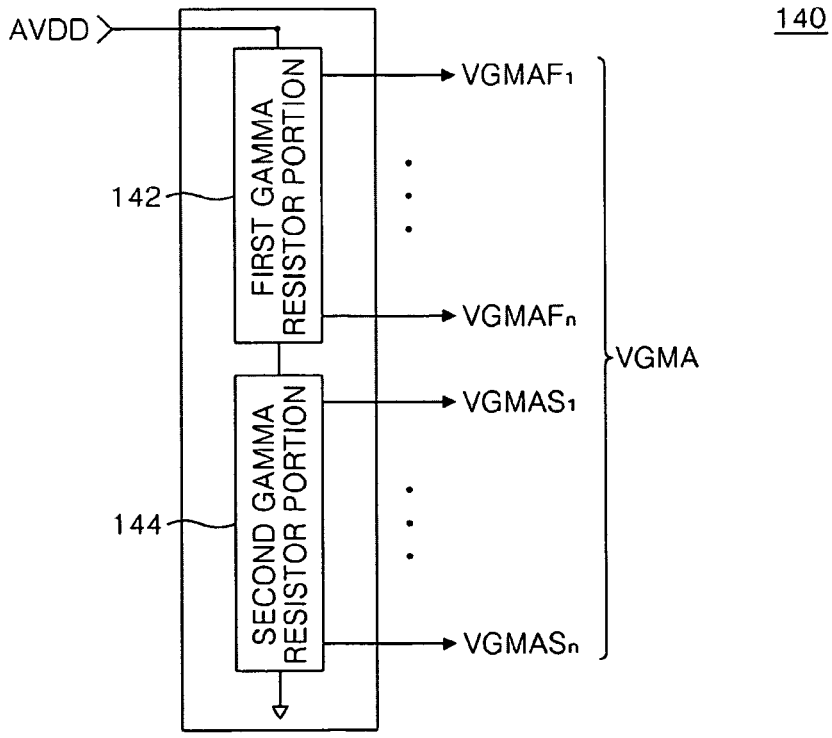
FIG. 3 is a block diagram illustrating a gamma voltage generator according to an exemplary embodiment of the present invention.

FIG. 3 is a block diagram illustrating the gamma voltage generator according to an exemplary embodiment of the present invention. The gamma voltage generator 140 comprises a first gamma resistor portion 142 and a second gamma resistor portion 144 that are connected between the analog power voltage AVDD and a ground.

The first gamma resistor portion 142 generates a plurality of first reference gamma voltages VGMAF1 to VGMAF*n* that are to be used in the first gray-scale region described in relation to Table 1. To this end, the first gamma resistor portion 142 comprises a plurality of resistors (not shown) for generating a plurality of first reference gamma voltages VGMAF1 to VGMAF*n* to be used in the first gray-scale region. The plurality of resistors of the first gamma resistor portion 142 have a characteristic of the first gamma curve that can generate the first reference gamma voltages VGMAF1 to VGMAF*n* corresponding to the first gamma value.

The second gamma resistor portion 144 generates a plurality of second reference gamma voltages VGMAS1 to VGMAS*n* that are to be used in the second gray-scale region described in relation to Table 1. To this end, the second gamma resistor portion 144 comprises a plurality of resistors (not shown) for generating a plurality of second reference gamma voltages VGMAS1 to VGMAS*n* to be used in the second gray-scale region. The plurality of resistors of the second gamma resistor portion 144 have a characteristic of the second gamma curve that can generate the second reference gamma voltages VGMAS1 to VGMAS*n* corresponding to the second gamma value.

Figure 4:
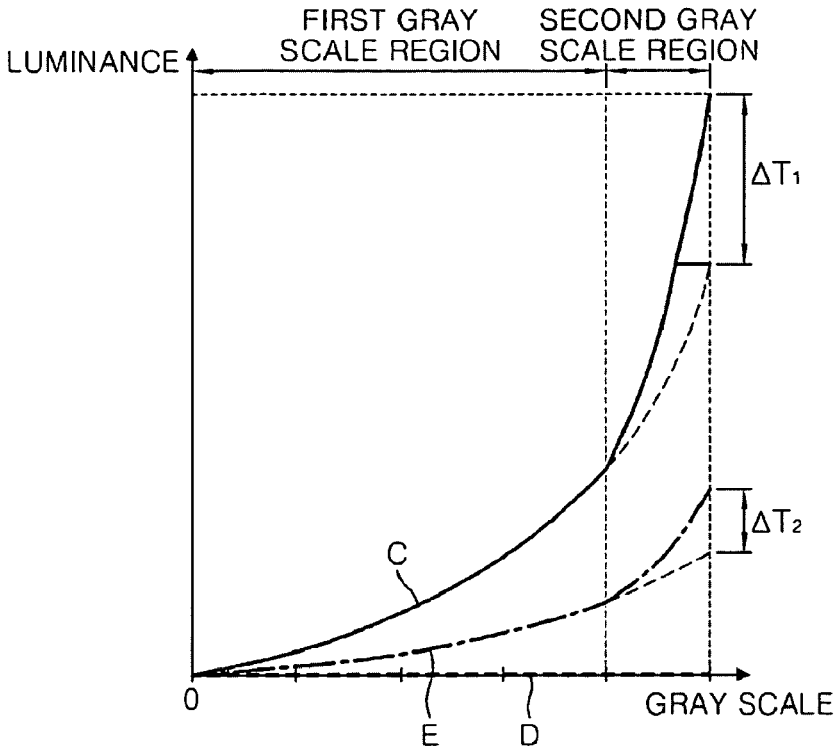
FIG. 4 is a graph illustrating a gamma curve used in the gamma voltage generator of FIG. 3.

FIG. 4 is a graph illustrating a gamma curve used in the gamma voltage generator of FIG. 3. In FIG. 4, a curve C denotes the first gamma curve having a gamma value applied to the display data, a curve D denotes the second gamma curve having a gamma value applied to the impulsive data, and a curve E denotes a third gamma curve having a gamma value displayed on the display device.

The curve C forming the first gamma curve may have a first gamma value of about 2.1 to about 2.3, preferably 2.2, in the first gray-scale region and may have a second gamma value of about 2.4 to about 3.1, preferably 2.5, in the second gray-scale region. The curve C has a grater gamma value in the second gray-scale region than in the first gray-scale region. The curve D forming the second gamma curve has a black gray-scale value in both of the first and second gray-scale regions.

Therefore, the gamma voltage generator 140 generates a reference gamma voltage corresponding to a gamma value of 2.2 when the display data having a gray scale corresponding to the first gray-scale region is inputted and generates a reference gamma voltage corresponding to a gamma value of 2.5 when the display data having a gray scale corresponding to the second gray-scale region is inputted.

The gray-scale display voltage according to the gamma value of the first gamma curve C may have a smaller value than the critical voltage Vc in a highest gray-scale region. In order to maintain a bend state of a liquid crystal and improve visibility of a moving picture, the gray-scale display voltage according to the gamma value of the second gamma curve D may have a value greater than the critical voltage Vc in the highest gray-scale region.

A dotted line connected to the curve C in the second gray-scale region is a curve corresponding to a gamma value of 2.2, a solid line of the curve C is a curve corresponding to a gamma value of 2.5. A white gray-scale, that is, a distance ΔT1 between an end point of the curve C of the second gray-scale region and an end point of the dotted line connected to the curve C means an improvement in the degree of transmittance obtained by selecting a higher gamma value in the second gray-scale region.

A distance ΔT2 between end points of a dashed dotted line and an end point of a dotted line of the curve E in the second gray-scale region corresponds to the distance ΔT1 and, thus, means an improvement in the degree of transmittance displayed on the display device 100.

The gamma voltage generator 140 displays the display data and the impulsive data on the display device 100 by using the first and second gamma curves and so makes greater a gray-scale difference distance of the gray scales displayed in the second gray-scale region, which is a high gray-scale region, thereby resolving the gray-scale inversion phenomenon that occurs in the high gray-scale region in the conventional display device.

Figure 5:
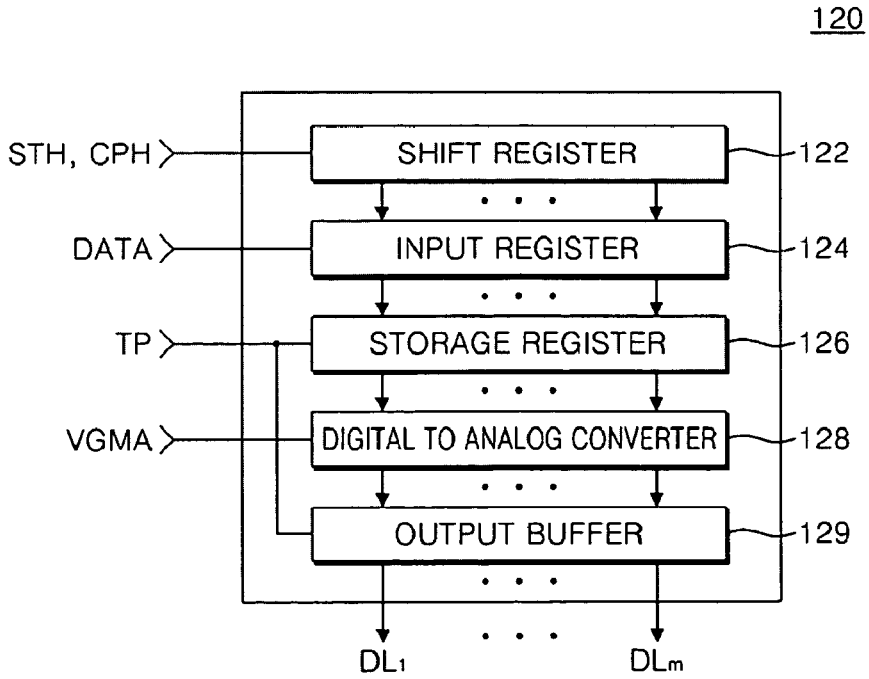
FIG. 5 is a block diagram illustrating a data driver according to an exemplary embodiment of the present invention.

FIG. 5 is a block diagram illustrating the data driver 120 according to a exemplary embodiment of the present invention. As shown in FIG. 5, the data driver 120 comprises a shift register 122, an input register 124, a storage register 126, a digital-to-analog (DA) converter 128, and an output buffer 129.

The shift register 122 receives the data start signal STH and the data synchronous clock signal CPH to generate a sampling signal and provides the sampling signal to the input register 124. More specifically, the shift register 122 shifts the data start signal STH per one period of the data synchronous clock signal CPH to generate m sampling signals.

The input register 124 sequentially stores the data DATA in response to the sampling signals sequentially inputted from the shift register 122. More specifically, the input register 124 stores the data DATA corresponding to one line in response to the sampling signals. The data DATA comprises the display data N and the impulsive data I.

The storage register 126 simultaneously receives and stores the data DATA corresponding to the one line stored in the input register 124 when the load signal TP is inputted. The load signal TP enables a gray-scale display voltage of the data DATA corresponding to the one line to be simultaneously applied to the pixel capacitors connected to one gate line, as shown in FIG. 1.

The DA converter 128 generates a gray-scale display voltage corresponding to the data DATA by using the reference gamma voltage VGMA and provides it to the output buffer 129.

The output buffer 129 comprises a plurality of amplifiers (not shown) for current-amplifying gray-scale display voltages supplied from the DA converter 128 and providing them to the data lines DL1 to DLm. The amplifier may be formed as a voltage follower.

Figure 6:
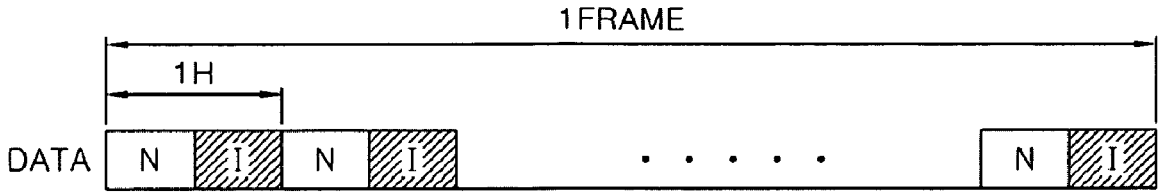
FIG. 6 shows a data frame displayed on the display device of FIG. 1.

FIG. 6 shows a data frame displayed on the display device of FIG. 1. Referring to FIG. 6, data of one frame contains a plurality of horizontal period (1H) data corresponding to a gate line. The data DATA of one horizontal period (1H) contains the display data N and the impulsive data I. The exemplary embodiment of the present invention has been described centering on a case where a duty ratio between the display data N and the impulsive data I of the one horizontal period (1H) is 1:1, but the present invention is not limited to this and can be applied to a duty ratio of 2:8, 4:6, 6:4, or 8:2.

An operation of the display device according to an exemplary embodiment of the present invention is described below.

First, the timing controller 150 stores the data DATA inputted at the first driving frequency in the storage portion 160, synchronizes the data DATA with the second driving frequency before reading out it, and provides the data DATA synchronized with the second driving frequency to the data driver 120. In this exemplary embodiment, the second driving frequency is a multiple of the first driving frequency.

The data driver 120 converts the data DATA supplied from the timing controller 150 into the gray-scale display voltage by using the reference gamma voltage VGMA supplied from the gamma voltage generator 140. More specifically, the data driver 120 converts the display data N into the first gray-scale display voltage according to the first gamma curve during the data display section and converts the impulsive data I into the second gray-scale display voltage according to the second gamma curve during the impulsive section, synchronizing them at the second driving frequency.

If the display data N has the low gray scale of 1 to 199 during the data display section, the data driver 120 converts the display data N into the gray-scale display voltage by using the reference gamma voltage generated by the first gamma resistor portion 142. The first gamma resistor portion 142 comprises a plurality of resistors (not shown) matched with 2.2, which is the first gamma value.

If the display data N has the high gray scale of 200 to 256 during the data display section, the data driver 120 converts the display data N into the gray-scale display voltage by using the reference gamma voltage generated by the second gamma resistor portion 144. The second gamma resistor portion 144 comprises a plurality of resistors (not shown) matched with 2.5, which is the second gamma value.

In the display device 100 according to the exemplary embodiment of the present invention, the gamma value applied to the display data N of the high gray scale is greater than the gamma value applied to the display data of the low gray scale. Therefore, because a difference between the gray scales in the high gray-scale region is large, the gray-scale inversion phenomenon occurring in the high gray-scale region may be prevented.

Insertion of the impulsive data I for the display data N corresponding to one horizontal period (1H) may be performed by the timing controller 150, or the data driver 120 under control of the timing controller 150.

Figure 7A:
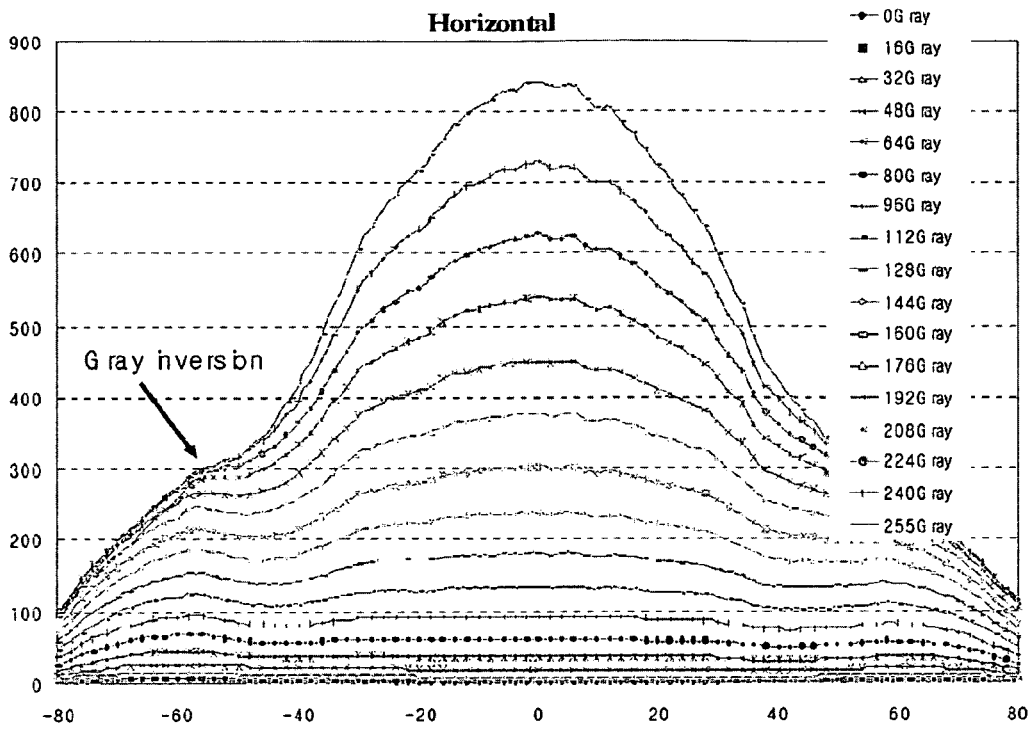
FIG. 7A is a graph illustrating a variation of luminance with respect to a viewing angle in a conventional display device.
Figure 7B:
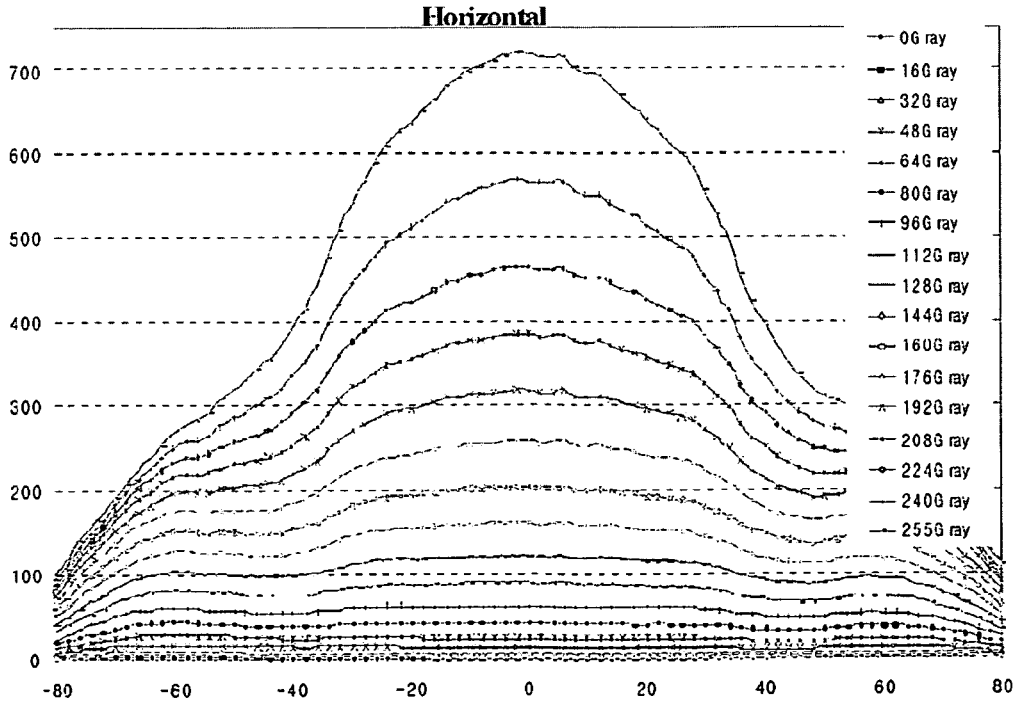
FIG. 7B is a graph illustrating a variation of luminance with respect to a viewing angle in a display device according to an exemplary embodiment of the present invention.

FIG. 7A is a graph illustrating a variation of luminance with respect to a viewing angle in a conventional display device, and FIG. 7B is a graph illustrating a variation of luminance with respect to a viewing angle in a display device according to an exemplary embodiment of the present invention. In this explanation, a viewing angle of 0° means a perpendicular direction to a rubbing direction.

Referring to FIG. 7A, in the conventional display device, there occurs the gray-scale inversion phenomenon wherein from a viewing angle of 50°, high gray-scale luminance is lower than low gray-scale luminance in the high gray-scale region of more than 240 gray scale.

Referring to FIG. 7B, in the display device according to the exemplary embodiment of the present invention, the gray-scale inversion phenomenon does not occur even in the high gray-scale region of more than 240 gray-scale. This is because the display device according to the exemplary embodiment of the present invention uses the gamma curve that has the higher gamma value in the high gray-scale region of 200 to 254 than in the low gray-scale region of 1 to 199 and so a luminance difference between gray scales in the high gray-scale region becomes large.

As described above, according to an exemplary embodiment of the present invention, the gamma value applied to the display data depends on the gray-scale region, and thus the gray-scale inversion phenomenon occurring in the high gray-scale region is prevented without requiring additional cost and lowering luminance.

Also, a luminance difference in the high gray-scale region is increased by raising the gamma value of the data gamma curve, and so the gray-scale inversion phenomenon occurring in the high gray-scale region is prevented.

Although the present invention has been described with reference to certain exemplary embodiments thereof, it will be understood by those of ordinary skill in the art that a variety of modifications and variations may be made to the present invention without departing from the spirit or scope of the present invention defined in the appended claims, and their equivalents.

What is claimed is:

1. A method for driving a display device, comprising:

dividing an entire gray-scale region corresponding to a data gray scale into a first gray-scale region and a second gray-scale region and setting a first gamma value of the first gray-scale region and a second gamma value of the second gray-scale region, the first gamma value being smaller than the second gamma value;

providing a first gray-scale display voltage corresponding to the data gray scale to a display panel during a first section of one horizontal period by using the first gamma value or the second gamma value selected by an inputted data gray scale; and providing a second gray-scale display voltage corresponding to a black gray-scale to the display panel during a second section of the one horizontal period.

2. The method of claim 1, wherein the second gray-scale region has a larger data gray scale than the first gray-scale region.

3. The method of claim 2, wherein the second gray-scale region occupies about 10% to about 40% of the entire gray-scale region.

4. The method of claim 3, wherein the first gamma value is set to about 2.1 to about 2.3, and the second gamma value is set to about 2.4 to about 3.1.

5. A display device, comprising:

a display panel having a liquid crystal that operates in response to first and second gray-scale display voltages; and a display panel driver for converting externally inputted data into the first and second gray-scale display voltages by using first and second gamma curves and providing the first and second gray-scale display voltages to the display panel, wherein the first gamma curve has a first gamma value of a first gray-scale region and a second gamma value of a second gray-scale region, the first gamma value being larger than the second gamma value, wherein the first and second gray-scale display voltages are provided by the display panel driver to the display panel during one horizontal period.

6. The display device of claim 5, wherein the first gamma curve is a gamma curve applied to the data, and the second gamma curve is a gamma curve for impulsive driving.

7. The display device of claim 5, wherein entire gray-scale region that the data has is a gray-scale region obtained by adding the first gray-scale region and the second gray-scale region, and the second gray-scale region occupies about 10% to about 40% of the entire gray-scale region.

8. The display device of claim 7, wherein the entire gray-scale region comprises a 1 to 256 gray scale, the first gray-scale region comprises a 1 to 199 gray scale, and the second gray-scale region comprises a 200 to 256 gray scale.

9. The display device of claim 8, wherein the first gamma value is about 2.1 to about 2.3, and the second gamma value is about 2.4 to about 3.1.

10. The display device of claim 9, wherein the display panel driver comprises a storage portion for storing the data inputted at a first driving frequency, and a timing controller for synchronizing the data stored in the storage portion with a second driving frequency that is a multiple of the second driving frequency before reading out.

11. The display device of claim 10, wherein the display panel driver further comprises a gamma voltage generator comprising a first gamma resistor portion having a characteristic of the first gamma value and a second gamma resistor portion having a characteristic of the second gamma value, the first gamma resistor portion generating a first reference gamma voltage, the second gamma resistor portion generating a second reference gamma voltage; and a data driver for generating the first gray-scale display voltage corresponding to a gray scale of the data by using the first and second reference gamma voltages and providing the first gray-scale display voltage to the display panel.

* * * * *